US005588866A

United States Patent [19]

Rothenberger

[11] Patent Number: 5,588,866

[45] Date of Patent: Dec. 31, 1996

[54] CONNECTOR SYSTEM WITH A ROLLER LATCHING MECHANISM

[75] Inventor: Richard E. Rothenberger, Harrisburg, Pa.

[73] Assignee: The Whitaker Corporation, Wilmington, Del.

[21] Appl. No.: 332,975

[22] Filed: Nov. 1, 1994

[51] Int. Cl.[6] ..... H01R 13/631

[52] U.S. Cl. ..... 439/372; 403/349

[58] Field of Search ..... 439/372, 953; 403/348, 349

[56] References Cited

U.S. PATENT DOCUMENTS

| | | | |
|---|---|---|---|
| 4,026,623 | 5/1977 | Goodman et al. | 439/372 |
| 5,002,418 | 3/1991 | McCown et al. | 403/349 |
| 5,073,127 | 12/1991 | Daly et al. | 439/473 |
| 5,105,095 | 4/1992 | Rudy, Jr. et al. | 307/17 |
| 5,310,352 | 5/1994 | Mroczkowski et al. | 439/76 |
| 5,340,255 | 8/1994 | Duran | 411/373 |

*Primary Examiner*—Gary F. Paumen
*Attorney, Agent, or Firm*—Anton P. Ness

[57] ABSTRACT

A connector system for interfacing two or more current-containing substrates includes a housing to which one of the substrates is mounted, a securing barrel assembled to the housing and extended from an actuating means through apertures within the substrates. A pair of rollers is secured to the leading end of the securing barrel. Upon actuating the securing barrel, the rollers are rotated about a roller support pin and along a camming surface on another substrate thereby cinching the substrates to each other.

9 Claims, 8 Drawing Sheets

CONNECTOR SYSTEM WITH A ROLLER LATCHING MECHANISM

FIELD OF THE INVENTION

The present invention relates to electrical connectors and, particularly, to connector systems which provide an effective electrical contact between current-containing substrates by means of a roller latching mechanism.

BACKGROUND OF THE INVENTION

Connector systems, particularly substrates interfacing electrical connector systems, are often used as links between electronic devices, such as analytical or diagnostic equipment having an input interfacer, and an outside source of electric signals which are indicative of the state of a system under observation. These connector systems typically include a connector module having two connector sides. On one of the connector sides, the connector module is interfaced with the outside source; and on the second connector side, the connector module is interfaced with the analytical or diagnostic device processing the data.

Sophisticated systems implemented for achieving high speed data communication between the outside source of data and the device, comprise a plurality of modular connectors and a printed wiring board to which these modular connectors are plugged. The printed wiring board contains a plurality of circuits that are adapted to communicate the data from the outside source to the device which processes the data. Contact surfaces on the printed wiring board are typically interfaced with a substrate in the device which is further adapted to receive the communicated data from the outside source. This substrate may be yet another printed wiring board, printed circuit board, or other electrical receiving device which can interface with the contact surfaces on the printed wiring board in the connector.

In order to interface the contact surfaces of the printed wiring board in the connector to another substrate and to achieve a sufficient electrical contact, a sufficient force is required to hold the contact surfaces firmly against the substrate during operation of the device. Typically, the printed wiring boards are merely screwed or otherwise mated in connectors and brought into contact with the substrate which is permanently mated to the device, thereby pressing the contact surfaces to the substrate. However, this is frequently an unsatisfactory method of ensuring complete electrical contact.

The U.S. Pat. No. 5,310,852 (assigned to The Whitaker Corporation, the assignor of the present invention) describes a substrate interfacing electrical connector system, having the ability to firmly mate the printed wiring board to a substrate in a device so that data can be bussed to the device through the connector with high reliability.

Referring to FIGS. 1, 2, the connector 10 comprises a printed wiring board ("PWB") 11 adapted to receive connector elements 12 which communicate data from an outside source 13 (schematically shown) to a device 14 (schematically shown), a housing 15 for mounting the printed wiring board 11, and a securing barrel 16 interfaceable through the printed wiring board 11 and further matable to a mating surface 17 in the device 14 for accessing the printed wiring board 11 to a substrate 18, such that the printed wiring board 11 makes effective electrical contact with the substrate 18. Interlocking means 19 attached to the securing barrel 16 is provided for cinching the securing barrel 16 to a cooperable locking surface 20 in the device 14. Upon actuation by an actuating means 21, by cinching the interlocking means 19 to the cooperable surface 20 in the device 14, the securing barrel 16 will exert a sufficient force to hold the contact surfaces 22 which are provided on the first side 23 of the printed wiring board 11 to the corresponding contacts 24 of an interposer 25, which serves to facilitate a contact between the printed wiring board 11 and the substrate 18 in the device 14.

The interlocking means 13 is integrally formed on a distal end of the securing barrel 16 from the same material as the securing barrel 16 and interfaces to the cooperating surface 20 to cinch the interlocking means 19 and the securing barrel 16, and thus, the connector 10, to the device side connector 26, and thereby, to the device 14.

After the device side connector 26 and the connector 10 are placed in initial operative association by passing the distal end of the securing barrel 16 through an aligned opening in the interposer 25, system printed wiring board 27 and a bolster plate 28, the securing barrel 16 and the interlocking means 19 are rotated upon manual activation of a grippable knob 29 which causes the interlocking means 29 to cinch the securing barrel 16 to the cooperating locking surface 20. This secures the connector 10 to the device side connector 26.

Referring now to FIG. 3, a cooperable locking surface 20 is a hub having a key camming surface 30 that is adapted to cooperatively engage with the key elements of the interlocking means 19 upon rotation of securing barrel 16 during manual actuation of actuating means 21. When the securing barrel 16 forces key against the key cam surface 30, the securing barrel 16 then rotates key along the camming surface 30 to pull bearing carrier 31 and connector 10 down, thereby imparting sufficient force to bring the contact surfaces 22 of PWB 11 firmly against the interposer contacts 24. The bearing carrier arrangement can exert between 20 (for low contact count) and 200 pounds (for high contact count) of force to accomplish this result. In a connector arrangement having, for example, six hundred (or six hundred and fifty) positions, the bearing carrier exerts 150 pounds of force to bring the interposer contacts 24 and contact surfaces 22 together. In other applications different interposer contacts may be used and different numbers of contacts may be provided, thereby modifying the amount of force necessary for assured mating.

Thus, the contact surfaces 22 on PWB 11 are brought firmly and assuredly into flush contact with interposer contacts 24 so that adequate electrical contact is maintained through the connector and data signals can thereafter be bussed into the device in a reliable and efficient fashion.

However, a further improvement which would assure high mechanical advantages of the connector system of the U.S. Pat. No. 5,310,352, but that could be provided by a lower rotational torque and with no lubrication required, would be desirable.

The present invention is the further improvement of the above-described connector system.

SUMMARY OF THE INVENTION

It is an object of the present invention to provide for a connector system having a latching means capable of withstanding high loads for extended periods of time.

It is another object of the present invention to provide a connector system assuring high mechanical advantages by applying low rotational torque.

The present invention finds particular utility in connector systems for interfacing two or more current-containing substrates for effective electrical contact.

In accordance with the teaching of the present invention, a connector system includes a housing means to which one of the substrates is mounted, and a securing means assembled to the housing means and extending from an actuating means (secured to an upper surface of the housing means) through apertures within the substrates.

The securing means include a securing barrel which is provided with an interlocking means on an end of the securing barrel spaced from the actuating means.

Upon actuating the securing means, the interlocking means are rotated along a camming surface of another substrate thereby cinching one of the substrates to another one.

The interlocking means includes a pair of rollers laced onto a roller support pin. The rollers are rotated about the roller support pin and roll along the camming surface until they have become seated into a pair of latching recesses on the camming surface.

The roller support pin is inserted into a transverse bore next to the end of the securing barrel, and includes two bearing pins, each of which is secured within the transverse bore. A distal end of each of the bearing pins includes a (first) ledge which being in engagement with a respective (second) ledge on the internal surface of the roller, secures the roller to the securing means.

These and other objects of the present invention will become apparent from a reading of the following specification taken in conjunction with the enclosed drawings.

GENERAL DESCRIPTION OF THE PREFERRED EMBODIMENTS

Figure 1:
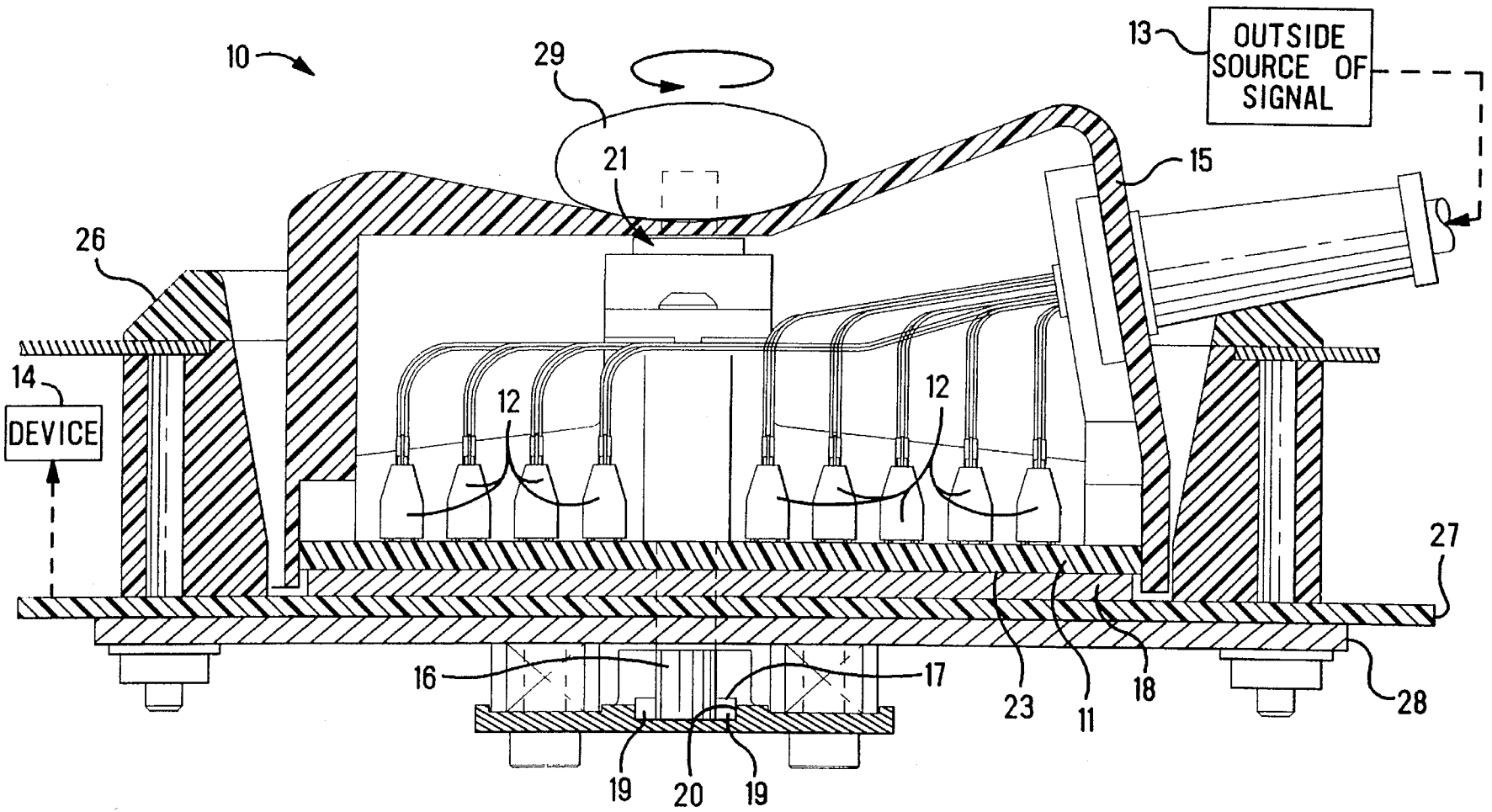
FIG. 1 PRIOR ART
FIG. 1 is a cross-sectional view of a connector system of the prior art.
Figure 2:
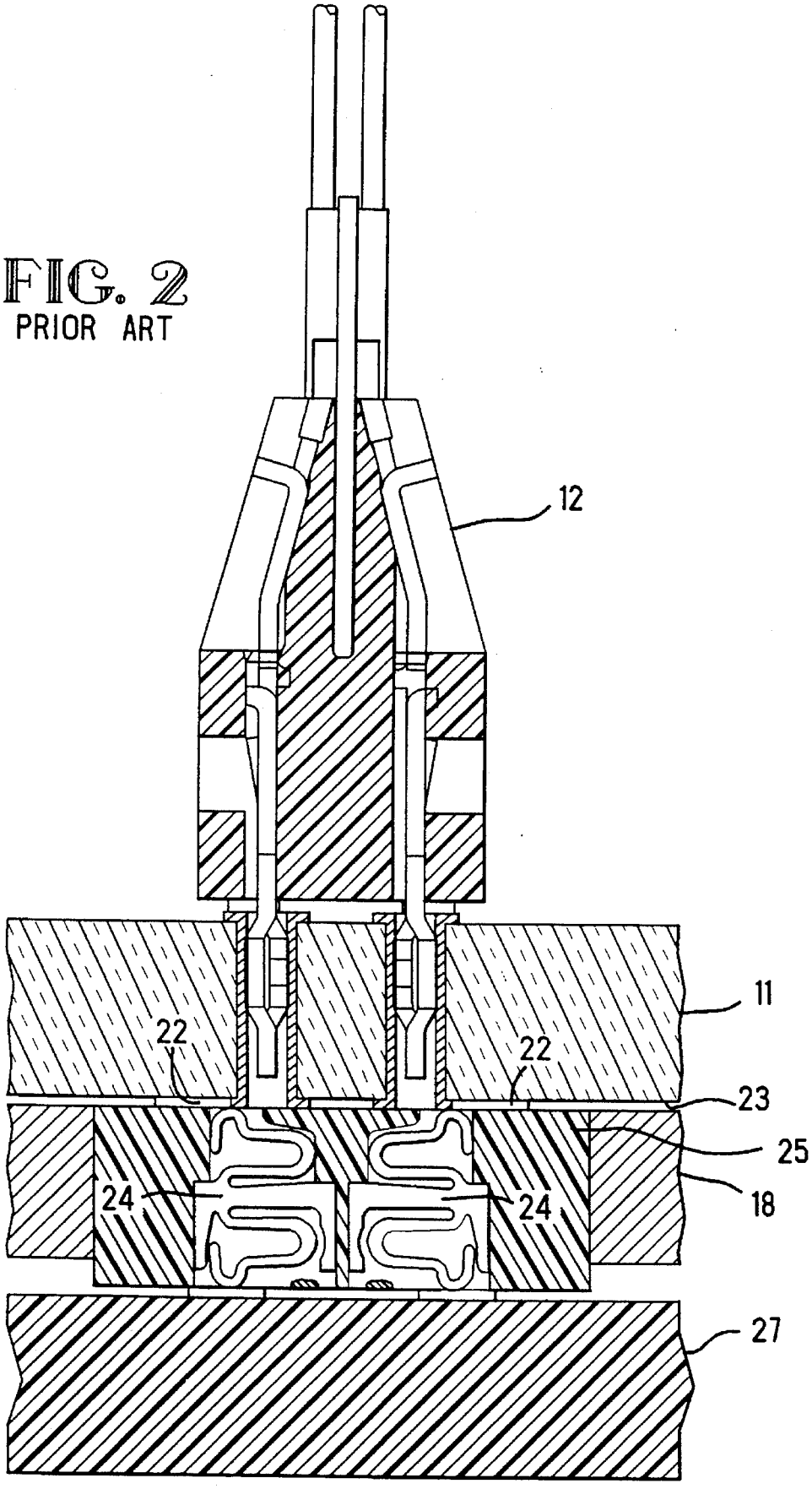
FIG. 2 PRIOR ART
FIG. 2 is an enlarged cross-sectional view of a single connector module of the prior art.

With reference to FIGS. 4–9, a connector system 110 is intended for use in an interfacing of a printed wiring board 111 and a substrate (or interposer) 125. It will be appreciated by those skilled in the art, that in this disclosure the term "substrate" means an electrical component secured to a device 114 (schematically shown in FIG. 4) which is adapted to receive electrical signals and can include a printed circuit board or a nest assembly such as an interposer. The term "printed wiring board" (PWB) means an electrical component that is adapted to bus data signals from an outside source 113 (schematically shown in FIG. 4) to the device 114. It could be a printed circuit board (PCB) or any other electrical component which busses electrical signals from one location to another. The connector system 110 includes a dielectric housing 15 where the printed wiring board 111 is mounted by means known by those skilled in the art. The PWB 111 has a first surface 132 and a second surface 133. The second surface 133, denoted the "contact" surface of the PWB 111, comprises a plurality of contact surfaces 122 outwardly exposed to make electrical contact with contacts of a substrate (or interposer) 125 in the device 114. The first surface 132 of the PWB 111 is adapted to attach the PWB 111 to a supporting structure of the connector 110.

A first surface 135 of the substrate 125 comprises an interposer adapted to make electrical contact with contact surfaces 122 located on the second surface 133 of the PWB 111.

The housing 115 has an upper surface 134 which is spaced from the PWB 111 secured to the housing 115. The substrate 125 interfaces by its second surface 136 with the system PWB 127 which is mated to the device side connector 126 (schematically shown in FIG. 4). The system PWB 127 may be, for example, a motherboard, which is adapted to receive and process the data being bussed through modular connectors (not shown) to the device side connector 126.

An actuating means 121 are secured to the upper surface 134 of the housing 115. Actuating means 121 comprise a securing barrel 116 which is assembled to the housing 115 and extends through a support structure 137. The PWB 111, the substrate 125 and the system PWB 127 include aligned and similarly shaped apertures 138, 139 and 140, respectively.

The securing barrel 116 is rotationally mated through apertures 138, 139 and 140 for securing and interfacing the second surface 133 of the PWB 111 to the substrate 125 and further to the second surface 136 of the substrate 125 to the system PWB 127. The securing barrel 116 has an end 141 which is spaced from the actuating means 121 and is protruded through the apertures 138, 139 and 140.

Figure 3:
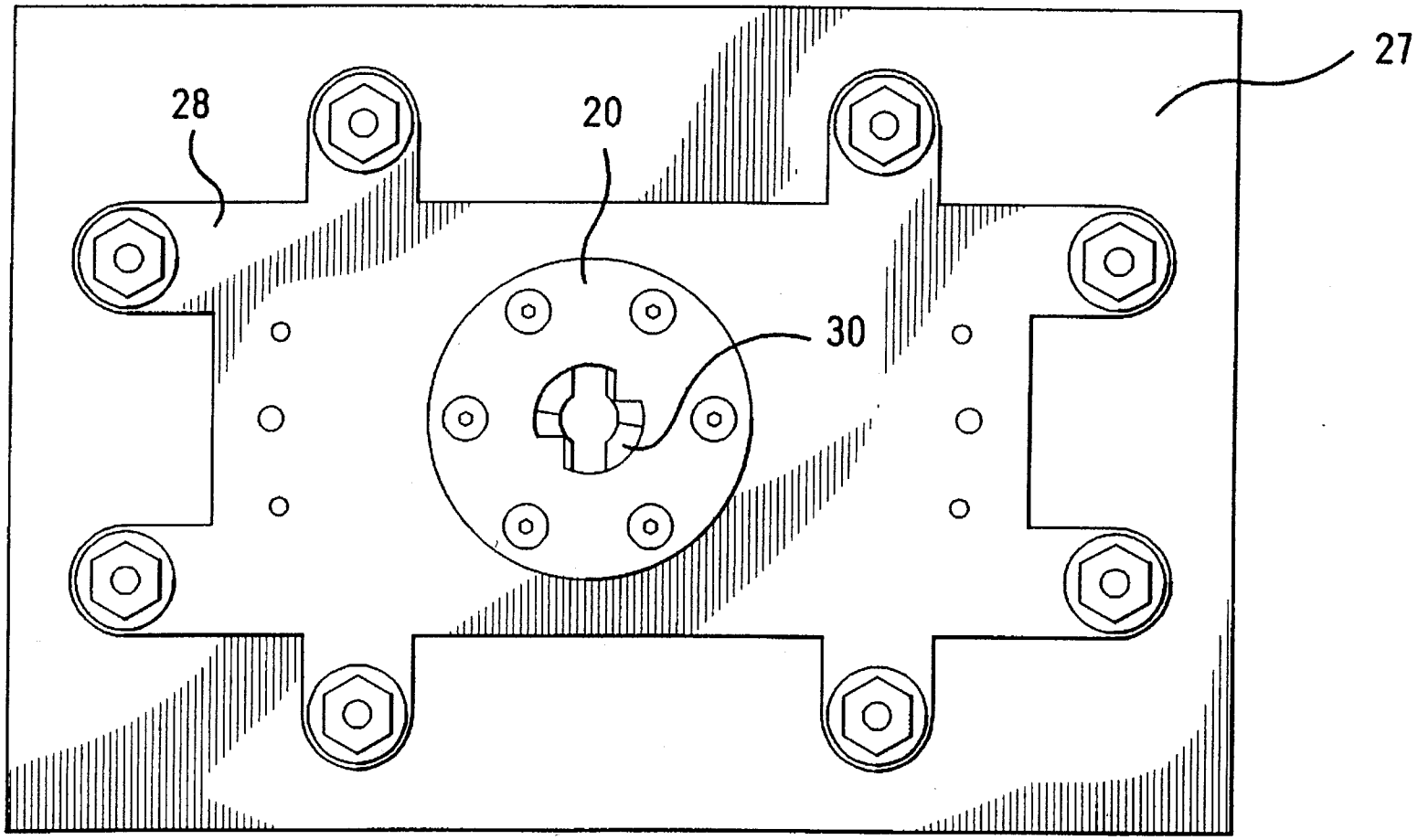
FIG. 3 PRIOR ART
FIG. 3 is a bottom view of a connector system of the prior art.
Figure 4:
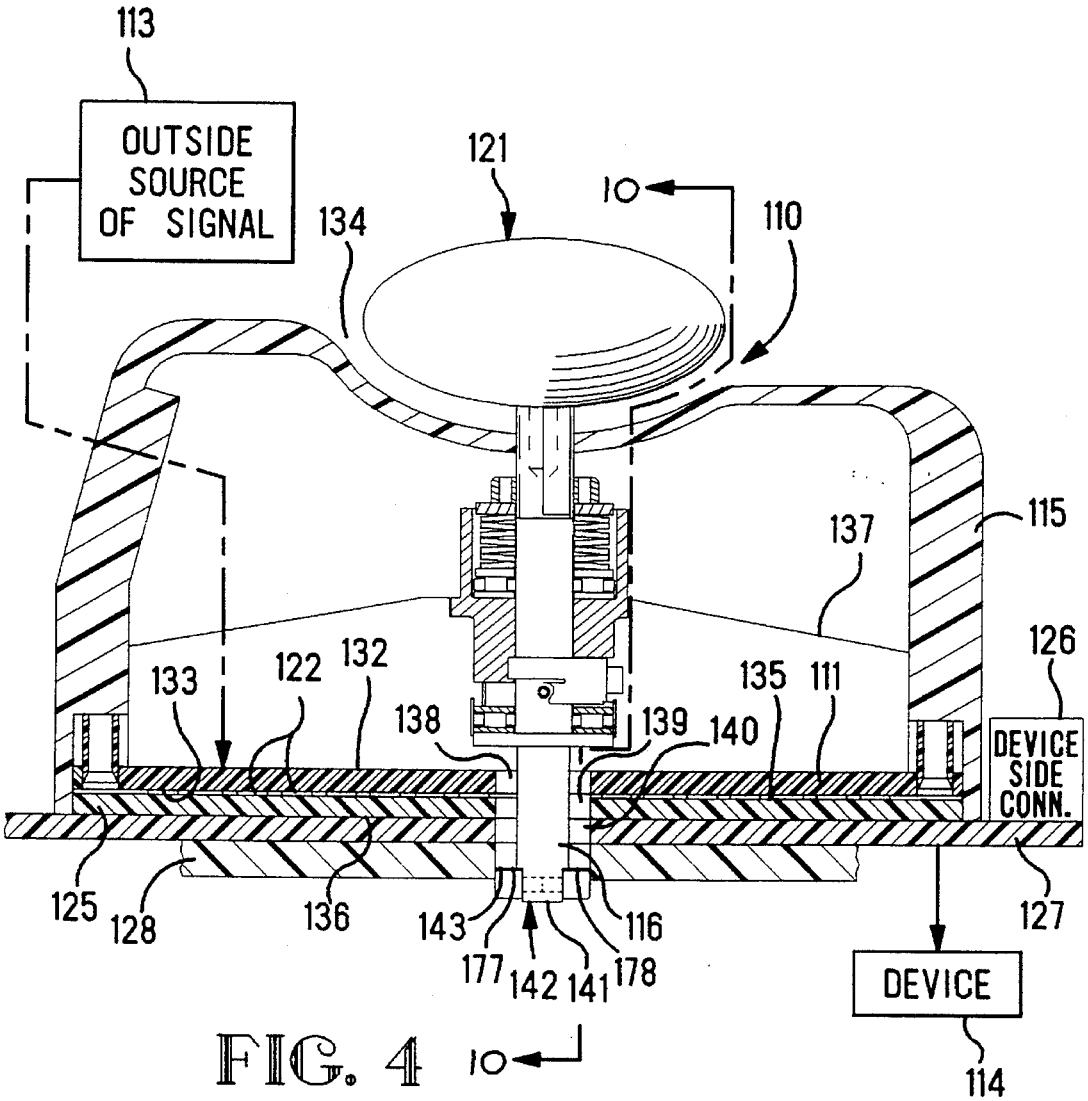
FIG. 4 is a cross-sectional view of a connector system of the present invention.
Figure 11:
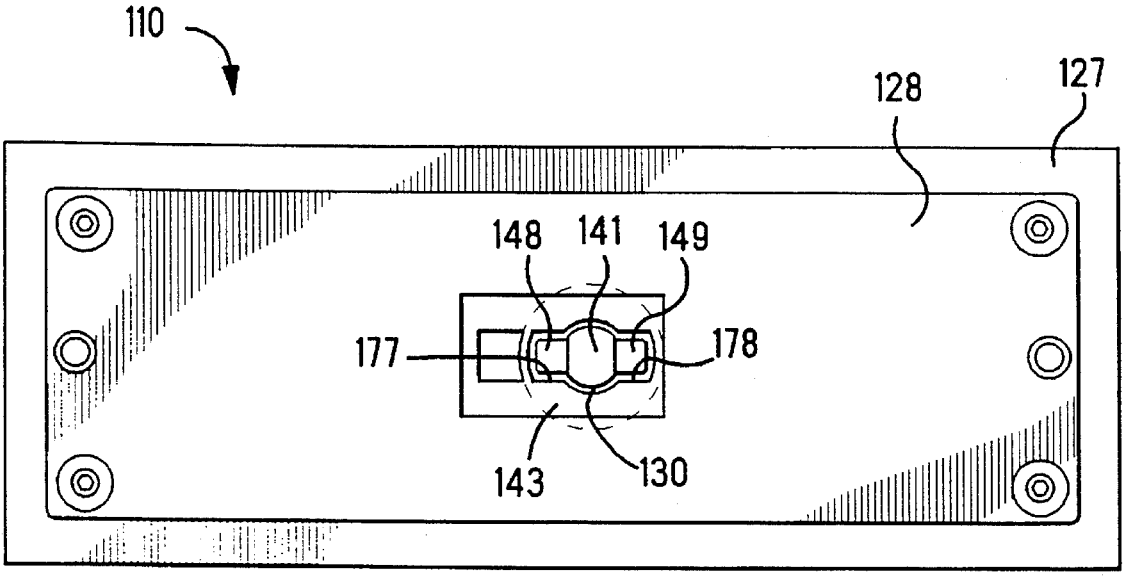
FIG. 11 is a bottom view of the connector system.
Figure 12:
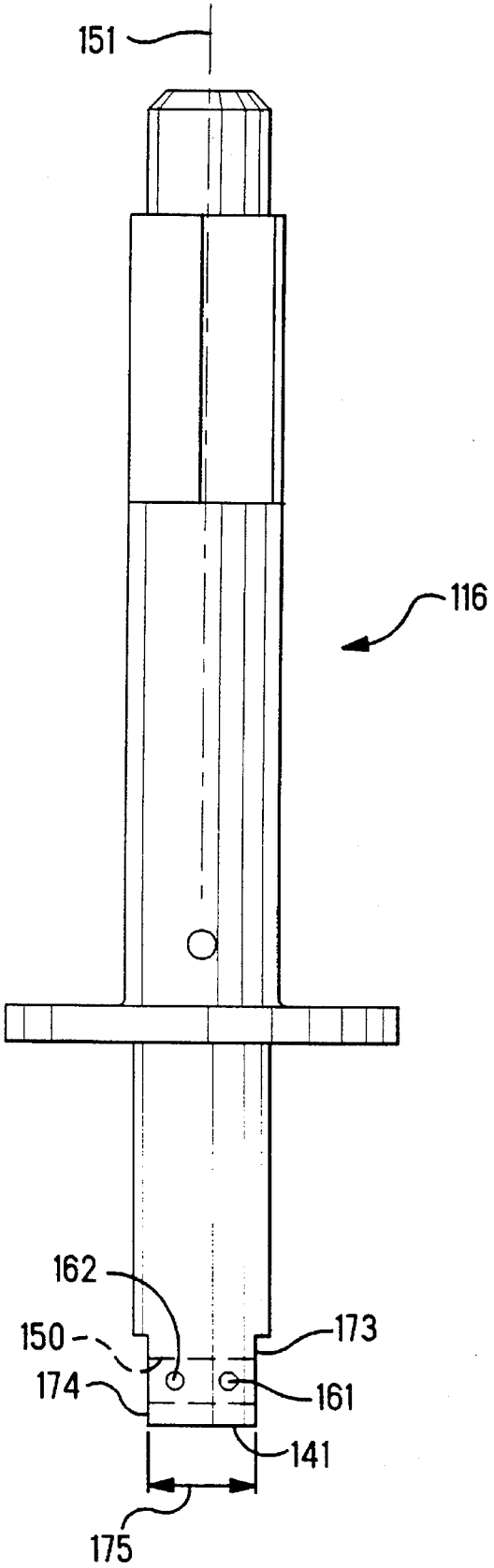
FIG. 12 is a front view of the securing barrel.

A roller latching mechanism 142 is provided on the end 141 for cinching the securing barrel 116 to a key camming surface 130 located on a surface 143 (as shown in FIG. 11) in the device side connector 126. It will be appreciated by those skilled in the art that the surface 143 is similar to the surface 120 shown in FIGS. 1, 3.

The camming surface 143 in the device side connector 126 is engaged to interlock the securing barrel 116 to the device 114 when actuating means 121 is actuated by manual rotation thereof. By cinching the interlocking key 142 to the camming surface 143, the securing barrel 116 will exert a sufficient force to hold the contact surfaces 122 which are provided on the second surface 133 of the PWB 111 to the corresponding contacts 124 of the substrate (interposer) 125 to the device side connector 126, thereby ensuring adequate electrical contact of the circuits of the PWB 111 to the circuits of the substrate (interposer) 125.

Referring again to FIGS. 4–10, the roller latching mechanism 142 includes a roller support pin consisting of a pair of bearing pins 146, 147 and a pair of rollers 148, 149 secured to the bearing pins 146, 147, such that the roller 148 is secured to the bearing pin 146, and the roller 149 secured to the bearing pin 147.

A transverse bore 150 is provided at the end 141 of the securing barrel 116 at ninety degrees to its longitudinal axis 151.

Figure 5:
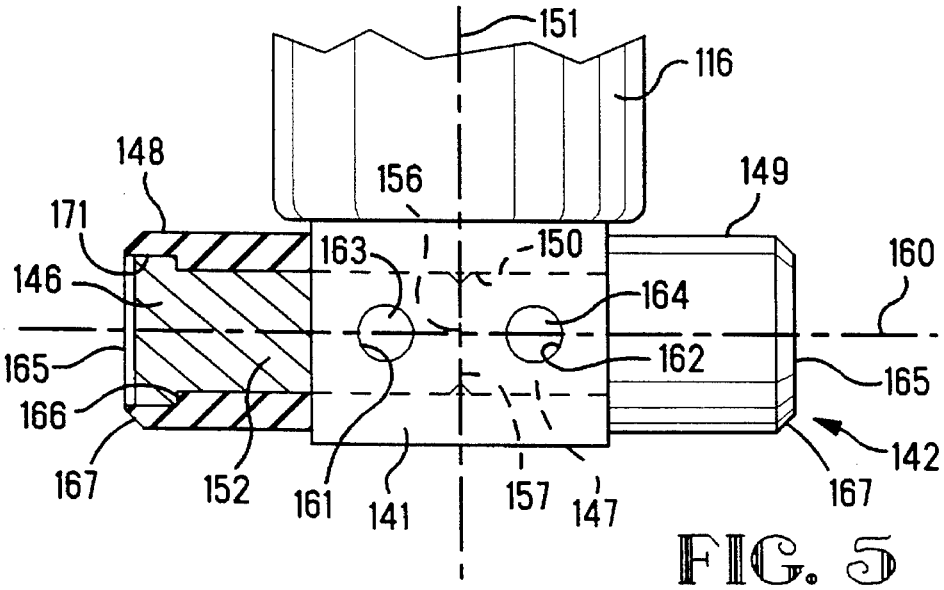
FIG. 5 is an enlarged partial sectional view of FIG. 4, showing a roller latching mechanism.
Figure 6:
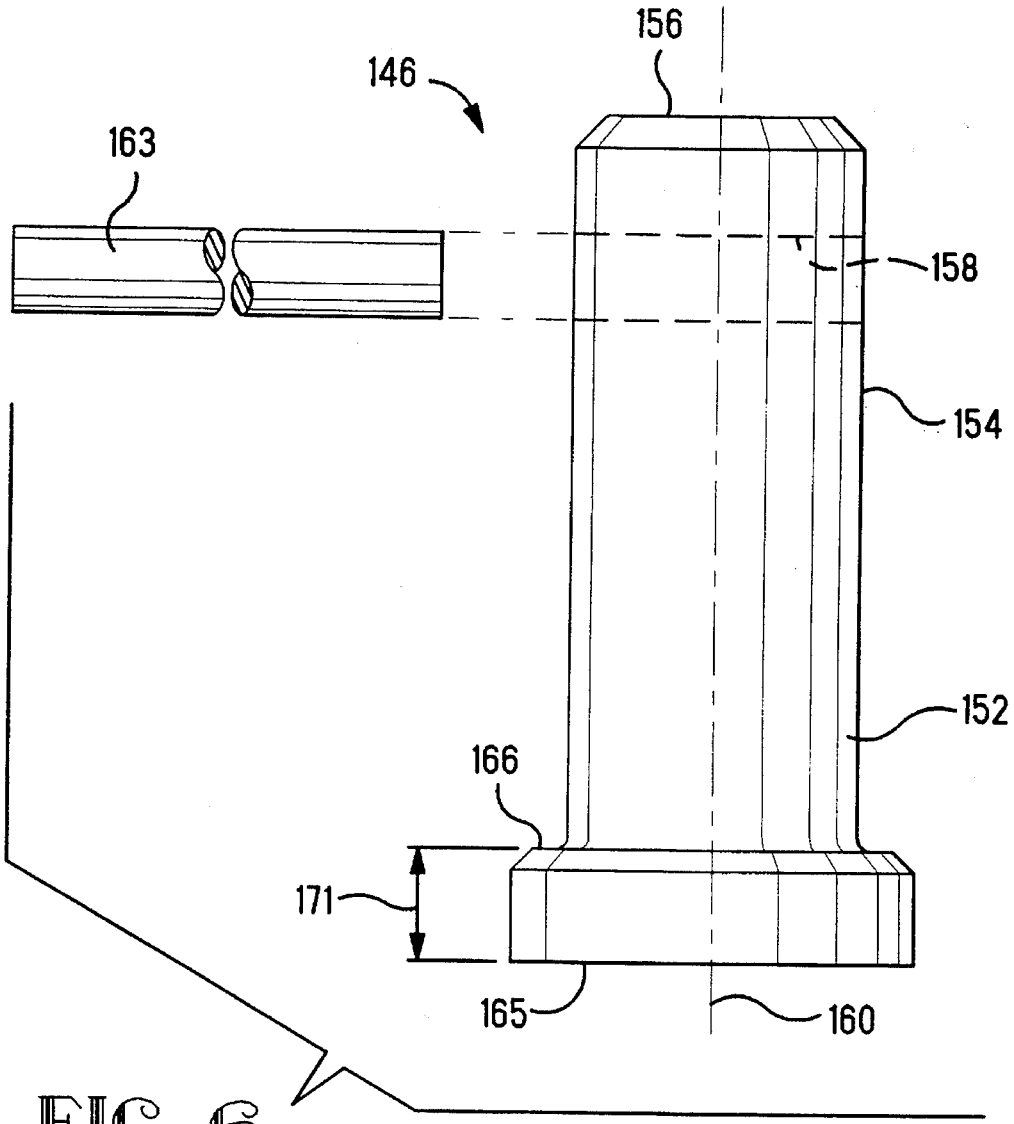
FIGS. 6, 7 are an enlarged front and side views of a bearing pin.
Figure 7:
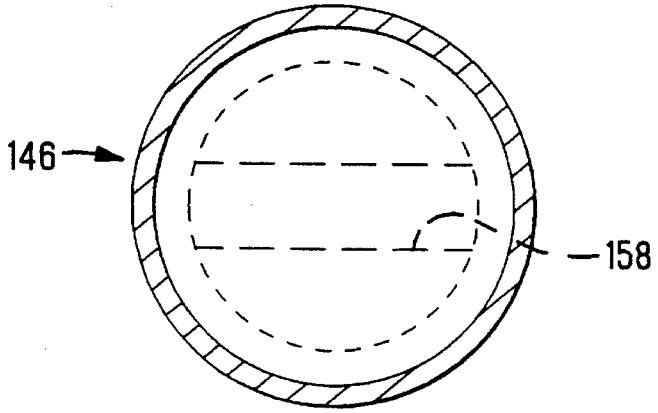
Figure 8:
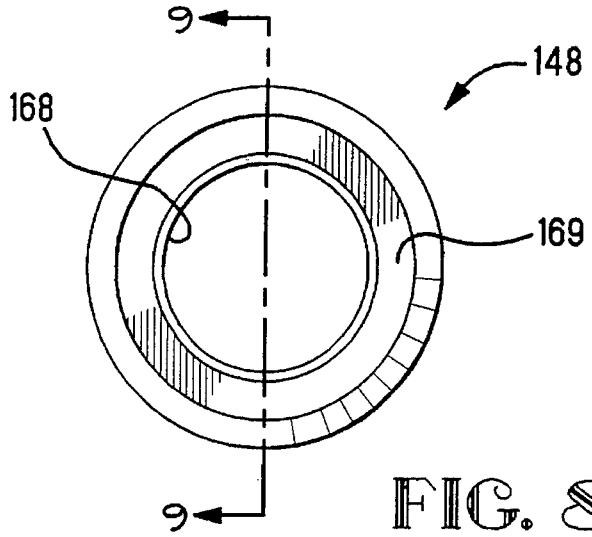
FIGS. 8, 9 are enlarged side and longitudinal cross-sectional views of the roller.
Figure 9:
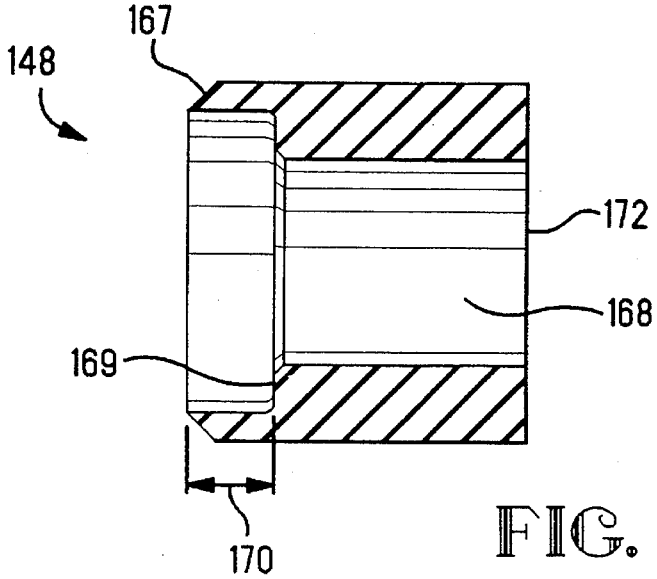

After the rollers 148, 149 are assembled onto the bearing pins 146, 147, the bearing pins 146, 147 are pressed into the transverse bore 150. As best shown in FIG. 5, the bearing pins 146, 147 have external portions 152, 153 which are extended from the securing barrel 116 in opposite directions. The rollers 148, 149 are placed onto the external portions 152, 153, respectively. The bearing pins 146, 147 and the rollers 148, 149 are plated with hard chrome.

The bearing pins 146, 147 include internal portions 154, 155, respectively. Each internal portion 154, 155 includes an end 156, 157, respectively. A transverse bore 158 is provided next to the end 156 of the bearing pin 146, and a transverse bore 159 is provided next to the end 157 of the bearing pin 147.

The transverse bores 158, 159 are provided at ninety degrees to a longitudinal axis 160 of the roller support pin. The holes 161, 162 through the securing barrel 116 are made in precise registration with the transverse bores 158, 159, such that when the bearing pins 146, 147 with the rollers 148, 149 on their external portions 152, 153 have been assembled into the transverse bore 150, pins 163, 164 (best shown in FIG. 5) are pressed into the holes 161, 162, thereby securing the internal portions 154, 155 of the bearing pins 146, 147 within the transverse bore 150.

Referring again to FIGS. 6–9, the external portion 152, 153 of each bearing pin 146, 147 has a respective distal end 165, where a ledge 166 is provided. Each roller 148, 149 includes a distal end 167 and has an internal cylindrical surface 168. A ledge 169 is spaced from the distal end 167 a predetermined length 170 corresponding to width 171 of the ledge 166 on the bearing pins 146, 147. Once the roller latching mechanism 142 is assembled, the ledge 166 on each bearing pin 146, 147 engages the ledge 169 on each roller 148, 149, thereby securing the rollers 148, 149 to the securing barrel 116 in a manner enabling them to rotate about bearing pins 146, 147 during actuation.

Figure 13:
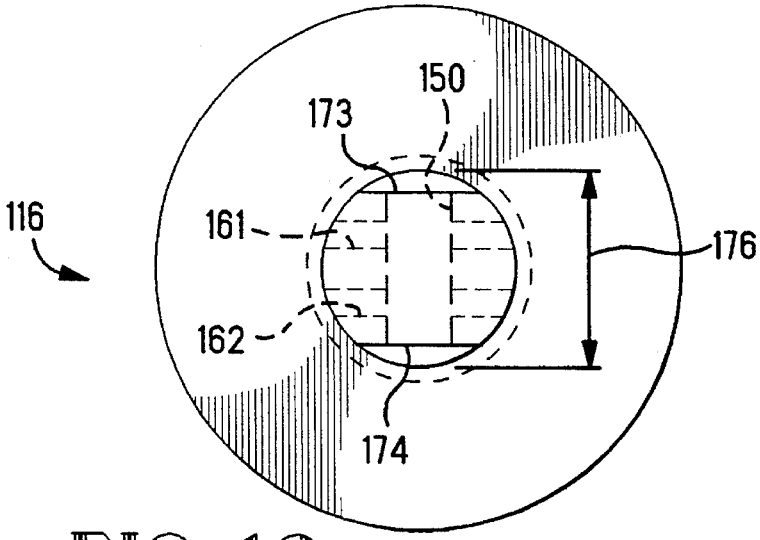
FIG. 13 is a side view of the securing barrel.
Figure 10:
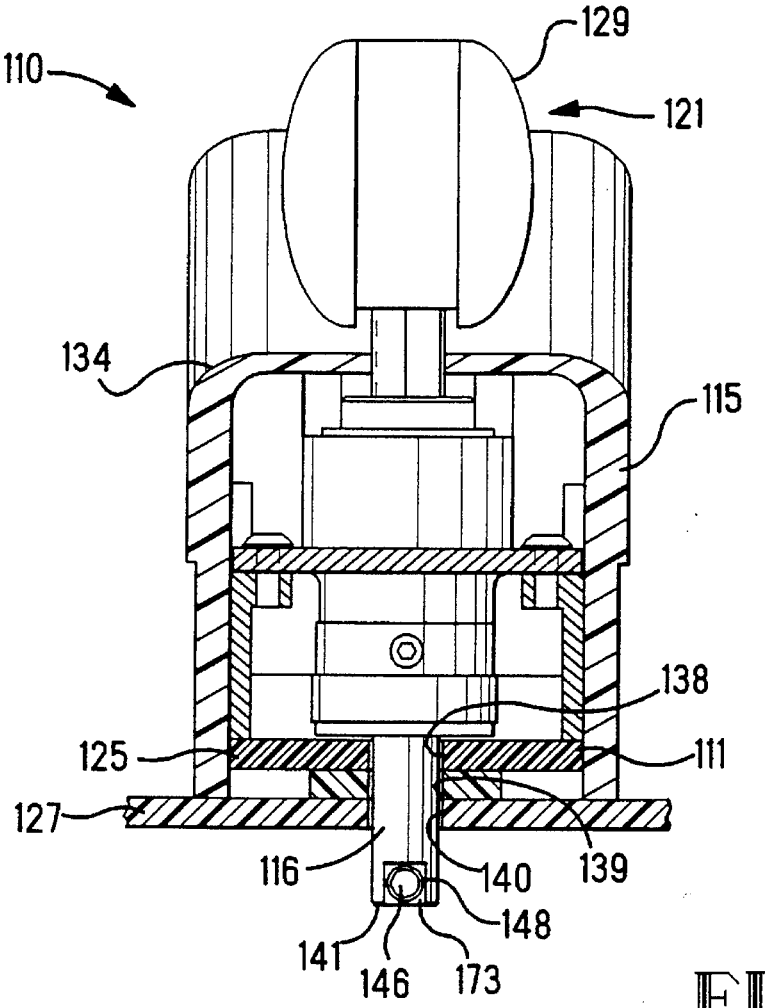
FIG. 10 is a cross-sectional view of FIG. 4 taken along lines 10—10.

A proximal end 172 of each roller 148, 149 leans against a flat square surfaces 173, 174, respectively, made at two sides of the securing barrel 116 next to the end 141. As best shown in FIGS. 5, 10 and 13, the transverse bore 150 is provided between the flat square surfaces 173 174. A distance 175 between the flat square surfaces 173, 174 is smaller than a diameter 176 of the cross-section of the securing barrel 116.

The ends 156, 157 of the internal portions 154, 155 of the bearing pins 146, 147 are adjacent to each other, however, they are not fastened to each other in order that each roller 148, 149 could rotate separately.

As best shown in FIG. 11, the camming surface 143 of the device side connector 126 has two latching recesses 177, 178. A plate providing the camming surface 143 could be cast in a single piece with a bolster plate 128 (shown in FIGS. 1, 3, 4, 11) of the device side connector 126, or alternatively secured thereto by screws or other fastening means.

When it is desired to mate the connector 110 to the device side connector 126, and to secure the PWB 111 to the substrate 125, the connector 110 is placed in initial operative association with the device side connector 126 by passing the end of the securing barrel 116 through the apertures 138, 139, 140 in the PWB 111, substrate 125, system PWB 127 and an aperture in the bolster plate 128 (all apertures are aligned). The securing barrel 116 and the roller latching mechanism 142 are then rotated upon manual activation of a grippable knob 129 which causes the roller latching mechanism 142 to cinch the securing barrel 116 to the camming surface 143. This will secure the connector 110 to the device side connector 126.

When the grippable knob 129 is rotated, a set of spring members (perfectly described in U.S. Pat. No. 5,310,852) operates to transmit the force generated by the camming of the roller latching mechanism 142 downward on the camming surface 143 and onto support structure 137 of the housing 115, thereby forcing the second surface 133 of the PWB 111 onto substrate (interposer) 125 with sufficient force to bring contact surfaces 122 into electrical engagement with the contacts 124 in the interposer 125. The force is preferably gradually applied through the securing barrel 116 as the roller latching mechanism 142 bears against the camming interface 143 during rotation through a quarter turn of the grippable knob 129. The mating procedure is accomplished when the rollers 148, 149 seat in the respective latching recesses 177, 178 of the camming surface 143, thereby providing for a latching means capable of withstanding high mechanical loads for an extended period of time. During rotation of the rollers 148, 149 along the camming surface 143, no excessive friction force is applied to the roller latching mechanism 144, and therefore, to the actuating means 121.

As the result of this advantage, the present invention provides a mechanical contact between the PWB 111, interposer 125, system PWB 127 and bolster plate 128, and effective electrical contact between the outside source 113 of data and the device 114 by applying a lower rotational torque to the actuating means 121. No lubrication is required on the camming surface 143.

Obviously, many modifications may be made without departing from the basic spirit of the present invention. The invention is herein described with particular reference to a connector system for interfacing a printed wiring board and an interposer, or two printed wiring boards, however, the principles of the invention are perfectly applicable to mating and unmating of any board-like substrates. Accordingly, it will be appreciated by those skilled in the art that within the scope of the appended claims, the invention may be practiced other than has been specifically described herein.

What is claimed is:

1. In a connector system for electrically mating and unmating opposing surfaces of at least two substrates wherein the surfaces each include a substantial plurality of electrical contact pads, one of said substrates includes an actuator having a leading end extending therebeyond for insertion through an aperture of said second substrate for interlocking means on a leading end of said actuator to cooperate with a camming surface of said second substrate adjacent said aperture, and further having an actuation section remote from said leading end, wherein upon actuation of the actuator by the actuating section, said interlocking means cinch said first substrate to said second substrate by being urged along said camming surface from a force-free position to a force-applying position, and wherein during actuation substantial friction forces are applied against the interlocking means thereby requiring a substantial rotational torque to be applied to the actuator, an improvement wherein said interlocking means comprise a pair of rollers secured to said leading end of said actuator, wherein upon actuation of said actuator, said pair of rollers are rotated about at least one roller support pin secured to said actuator and roll along the canning surface with no substantial friction forces from the force-free position to the force-applying position, thereby reducing a rotational torque required to achieve a high-load mechanical and electrical contact between said opposing surfaces of said substrates, over many mating/unmating cycles.

2. The connector system of claim 1, wherein the actuator includes a securing barrel, wherein the end of the securing barrel includes a transverse bore at ninety degrees to a longitudinal axis of the securing barrel;

a roller support pin being inserted in said transverse bore, the roller support pin having a first and a second bearing pin, each of said first and second bearing pins having an internal and external portion, respectively, a respective one of said rollers being placed on said external portion of each of said first and second bearing pins partially exposed a predetermined length from the securing barrel in opposite directions.

3. The connector system of claim 2, wherein an internal portion of each of said first and second bearing pins includes an internal end, respectively, wherein a transverse bore is provided next to the internal ends at ninety degrees to a longitudinal axis of each of said first and second bearing pins, wherein a pin is pressed into said transverse bore on each of said first and second bearing pins, respectively, thereby supporting each of said first and second bearing pins within the transverse bore in the securing barrel.

4. The connector system of claim 2, wherein an external portion of each of said first and second bearing pins include a distal end, wherein a first ledge is provided next to the distal end.

5. The connector system of claim 4, wherein each roller includes a distal edge, wherein each roller includes a cylindrical internal surface, said cylindrical internal surface having a second ledge spaced a predetermined length from the distal edge of the roller, wherein the first ledge on each of said first and second bearing pins engages a respective second ledge of the respective roller, thereby securing the roller on the respective each of said first and second bearing pins.

6. The connector system of claim 2, wherein the securing barrel includes a pair of spaced flat surfaces next to the end of the securing barrel, a distance between said plate surfaces being shorter than a diameter of a cross-section of the securing barrel, and wherein the transverse bore is provided between said flat square surfaces.

7. The connector system of claim 2, wherein the rollers are plated with hard chrome.

8. The connector system of claim 2, wherein the first and second bearing pins are plated with hard chrome.

9. The connector system of claim 2, wherein the securing barrel is made of a rigid material.

* * * * *